US006425682B1

(12) United States Patent
Klaus

(10) Patent No.: US 6,425,682 B1
(45) Date of Patent: Jul. 30, 2002

(54) TEMPORARY LIGHTING APPARATUS AND CAGE THEREFOR

(75) Inventor: Dale A. Klaus, St. Albans, MO (US)

(73) Assignee: Engineered Products Co., Plymouth, MN (US)

( * ) Notice: Subject to any disclaimer, the term of this patent is extended or adjusted under 35 U.S.C. 154(b) by 0 days.

(21) Appl. No.: 09/660,115

(22) Filed: Sep. 12, 2000

Related U.S. Application Data

(60) Provisional application No. 60/154,746, filed on Sep. 17, 1999.

(51) Int. Cl.[7] ..... F21V 15/02

(52) U.S. Cl. ..... 362/376; 362/378; 362/391; 362/249

(58) Field of Search ..... 362/249, 391, 362/374, 375, 376, 378, 399, 400, 226

(56) References Cited

U.S. PATENT DOCUMENTS 2,376,316 A * 5/1945 Schwartz ..... 362/378
3,078,367 A * 2/1963 Jackson ..... 362/376
3,087,054 A * 4/1963 Jones ..... 362/378
3,594,681 A * 7/1971 Weiss ..... 362/378
3,609,348 A * 9/1971 Marasco ..... 362/378
4,141,062 A * 2/1979 Trueblood ..... 362/378
4,791,541 A 12/1988 Simmons ..... 362/376
4,841,420 A * 6/1989 Baggio et al. ..... 362/249
5,662,407 A * 9/1997 Fischer et al. ..... 362/375

* cited by examiner

*Primary Examiner*—Thomas M Sember
(74) *Attorney, Agent, or Firm*—Schwegman, Lundberg, Woessner & Kluth, P.A.

(57) ABSTRACT

A lighting apparatus includes a first portion and a second portion which form an enclosure for a light source. The first portion extends from a first end to a second end, where the first end has a collar adapted to couple with an electrical socket with a snap fit connection. The electrical socket receives a light source therein. The second end of the first portion is hingedly coupled with the second portion, thereby allowing removal of the light source.

20 Claims, 11 Drawing Sheets

TEMPORARY LIGHTING APPARATUS AND CAGE THEREFOR

RELATED APPLICATIONS

This application claims the benefit of U.S. Provisional Application Ser. No. 60/154,746, filed Sep. 17, 1999 under 35 U.S.C. 119(*e*).

FIELD OF THE INVENTION

The present invention relates generally to a temporary lighting apparatus. More particularly, it pertains to a temporary lighting apparatus including a cage for protection of a light source.

BACKGROUND OF THE INVENTION

Temporary lighting is often used for events which do not permit nor require permanent lighting structure. For instance, temporary lighting may be needed at a festival or a construction site, or seasonally at a Christmas tree lot. One form of temporary lighting is to string a plurality of light sockets with light bulbs coupled therewith. However, this type of an arrangement can be dangerous if one or more of the bulbs is accidentally struck and broken by a tool, or by dropping onto the ground.

Protective cages have been provided which encompass a light bulb. For example, U.S. Pat. No. 4,791,541, which issued on Dec. 13, 1998, has a protective cage for a lamp which hingedly couples a cage with a socket with a living hinge, where the cage has multiple living hinges. However, this type of cage can be difficult to assemble. Further, the living hinges can become worn.

Accordingly, what is needed is a lighting apparatus which protects the light source and does not become displaced when the light source is changed. What is also needed is a temporary lighting apparatus which is easy to install and uninstall. What is further needed is a lighting apparatus which does not become hot from the heat of the light source.

SUMMARY OF THE INVENTION

One embodiment includes a cage for a lighting apparatus. The cage includes a first portion and a second portion forming an enclosure for a light source. The first portion extends from a first end to a second end with the first end including a collar portion adapted to couple with an electrical socket having a snap fit connection. The second end of the first portion hingedly couples with the second portion.

One embodiment includes a temporary lighting apparatus. The temporary lighting apparatus includes a cage having a first portion and a second portion with the cage forming an enclosure for a light source. The first portion of the cage extends from a first end to a second end with the second end of the first portion hingedly coupled with the second portion. The temporary lighting apparatus also includes an electrical socket couplable with the light source and the cage is coupled to the electrical socket with a snap fit connection.

The temporary lighting apparatus allows for the units to be quickly installed and uninstalled with the snap-fit coupling, also saving in labor costs. The lighting apparatus beneficially can be installed without the use of tools or hardware. In addition, the temporary lighting apparatus provides an inexpensive approach to installing and manufacturing the product. Furthermore, the lighting apparatus is easy to use and does not get too warm to handle from the heat of the light source.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

DESCRIPTION OF THE PREFERRED EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
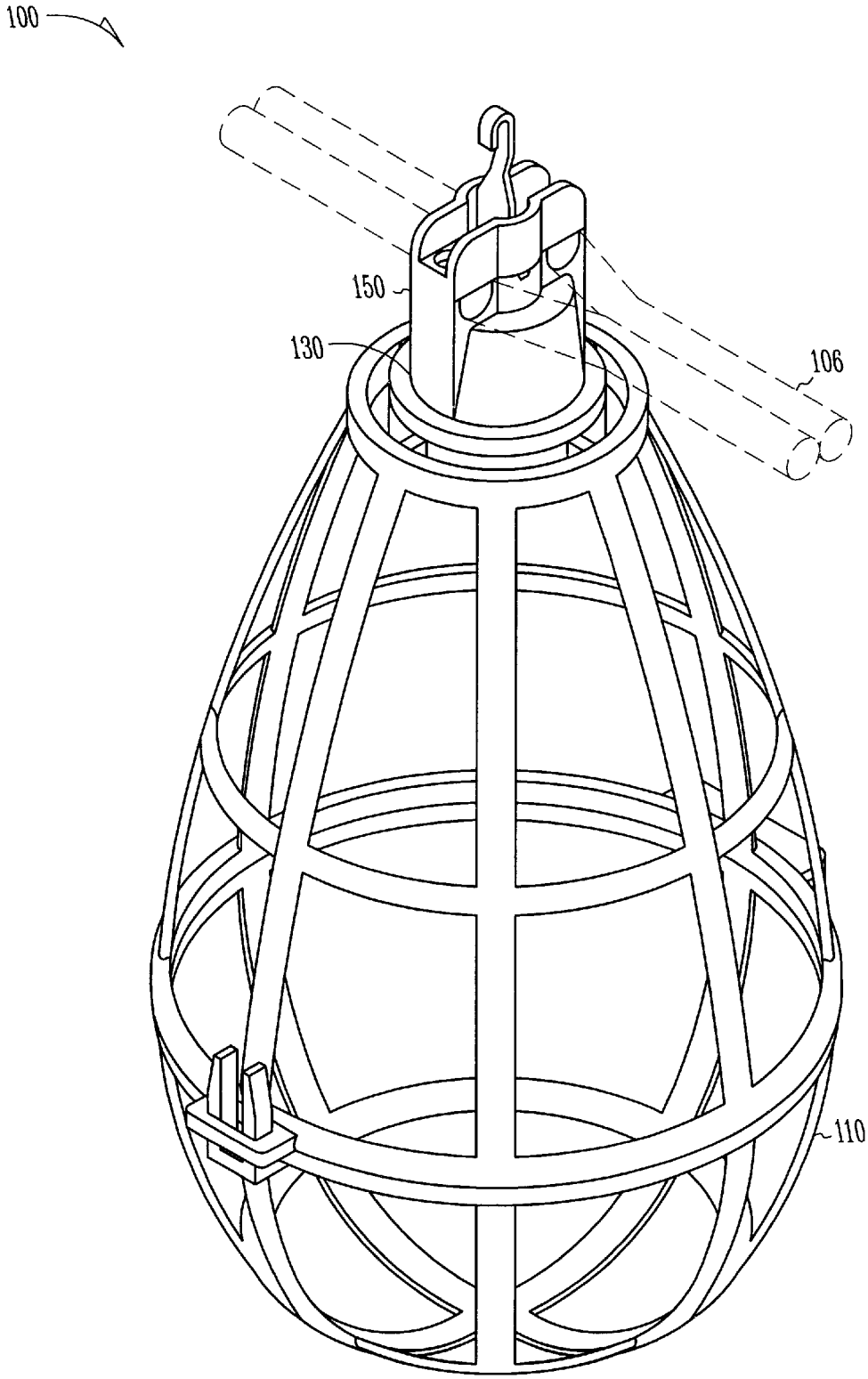
FIG. 1 is a perspective view of a temporary lighting apparatus constructed in accordance with one embodiment of the present invention.
Figure 2:
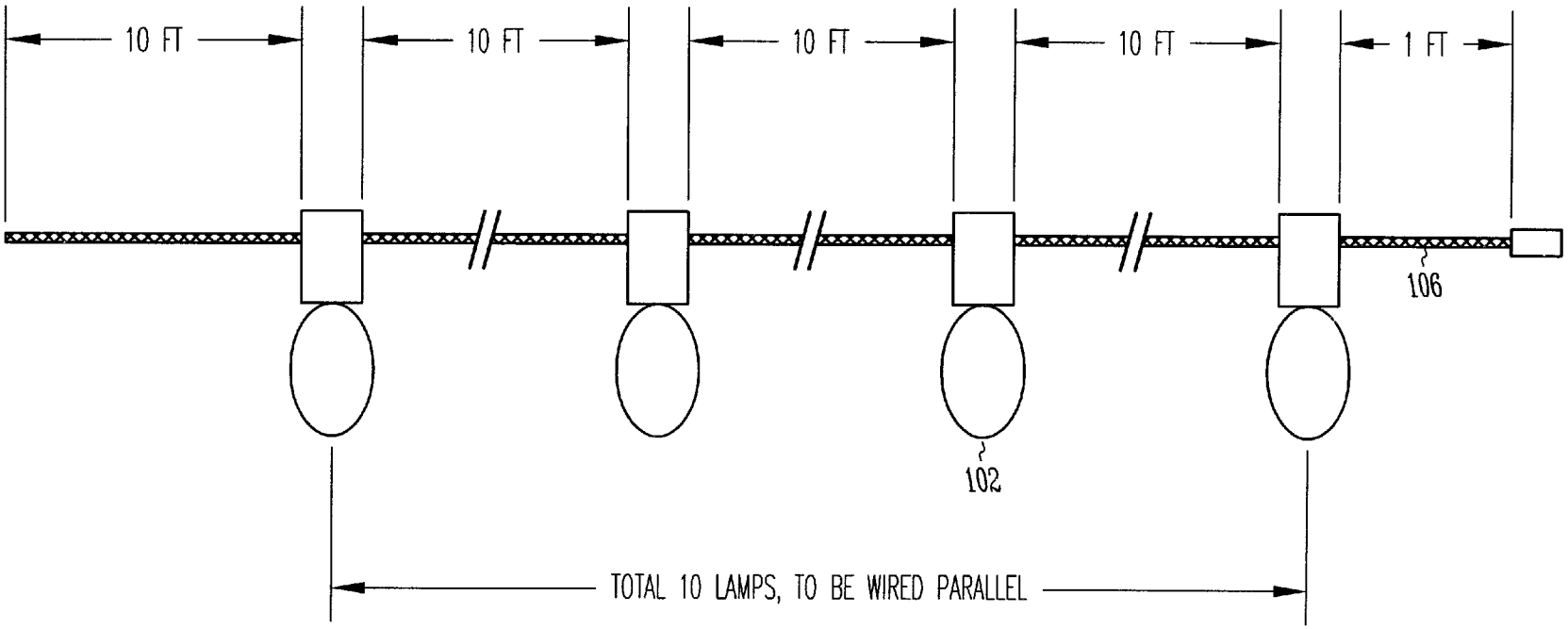
FIG. 2 is a block diagram of a plurality of devices constructed in accordance with the one embodiment of the present invention.
Figure 5:
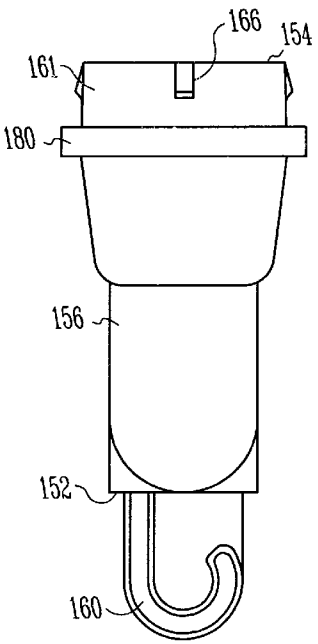
FIG. 5 is a second side elevational view illustrating an electrical socket of the temporary lighting apparatus.
Figure 3:
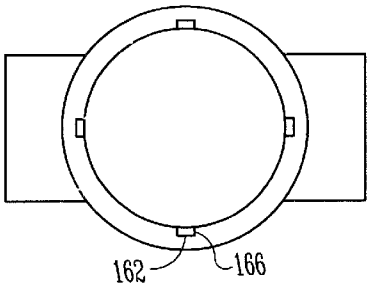
FIG. 3 is a bottom plan view illustrating an electrical socket of the temporary lighting apparatus.
Figure 4:
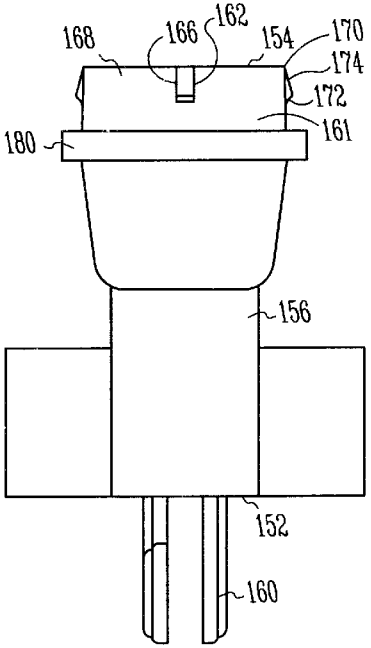
FIG. 4 is a first side elevational view illustrating an electrical socket of the temporary lighting apparatus.

A lighting apparatus 100 is shown in FIG. 1. As shown in the Figure, the lighting apparatus includes a cage 110 and an electrical socket 150, where the cage 110 is adapted to be coupled with the electrical socket 150 with a snap-fit coupling 130 disposed between the cage 110 and the electrical socket 150. The electrical socket 150 is electrically coupled with a cable 106. A plurality of lighting apparatuses 102 are coupled with the cable 106, for example, ten feet apart, as shown in FIG. 2. The cable 106 strands together one or more lighting apparatuses 102. FIGS. 3–5 illustrate the electrical socket 150 in greater detail.

The electrical socket 150 extends from a top end 152 to a bottom end 154, and an intermediate portion 156 therebetween. The cage 110 (FIG. 1) is coupled with the bottom end 154 of the electrical socket 150, as shown in FIG. 1 and as discussed further below. The top end 152 includes a fastener 160 such as a hook or clip which allows for the electrical socket 150 to be attached or hung from a line or other structure. The intermediate portion 156 couples electrical cable 106 (FIG. 1) with the electrical socket 150. A light source 188 (FIG. 8) is disposed within the electrical socket 150, where the light source 188 (FIG. 8) is electrically coupled with the electrical socket 150. In one embodiment, the electrical socket 150 includes threads within the socket 150. However, the light source can be coupled within the electrical socket 150 in other manners.

The bottom end of the electrical socket 150 includes a first outer ring 161 and a second outer ring 180. The second outer ring 180 is disposed on the intermediate portion 156 and is offset from projections 166 disposed on the first outer ring 161. The second outer ring 180 provides a stop for the cage 110 (FIG. 1). Disposed on the first outer ring 161 is at least one snap-fit coupling feature 162. In one embodiment, a plurality of snap-fit coupling features 162 are disposed on the first outer ring 161. The snap-fit coupling feature 162 comprises a projection 166 which extends from a surface 168 of the first outer ring 161. The projection 166 is, in one embodiment, angled from a top surface 170 to a bottom surface 172, providing an angled portion 174 therebetween. The angled portion 174 facilitates disposing the cage 110 (FIG. 1) over the projection 166 until the cage 110 is snap-fitted into place.

Figure 14:
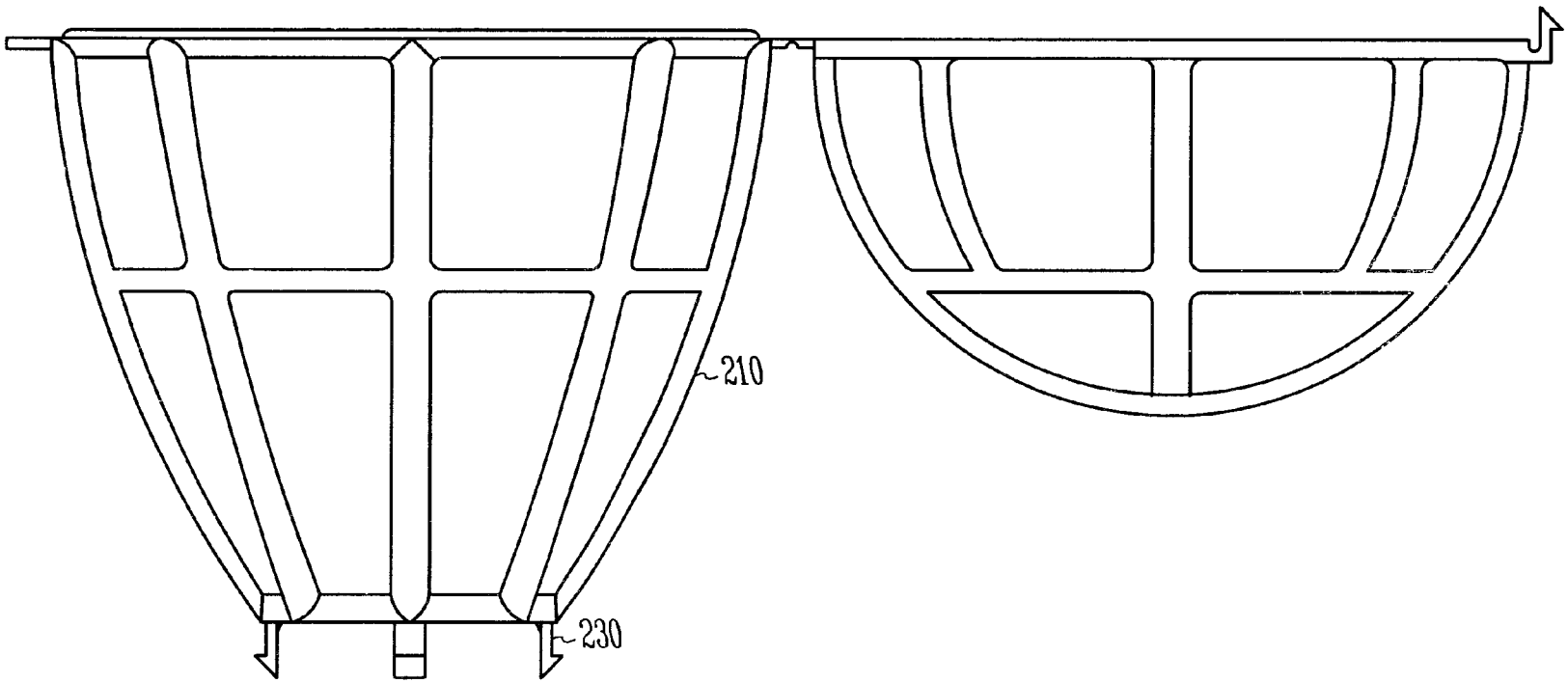
FIG. 14 is a side elevational view illustrating a cage of the temporary lighting apparatus made in accordance with another embodiment of the present invention.

A plurality of snap fit coupling features 162 are provided as shown in FIG. 3. The snap fit coupling features 162 include projections 166 and are disposed at 90 degrees around the circumference of the first outer ring 161. Alternatively, other types of snap-fit connections can be incorporated to couple the electrical socket 150 with the cage 110 and are considered within the scope of the invention. For instance, FIG. 14 illustrates a cage 210 which has projections 230 for use with a recessed socket.

Figure 8:
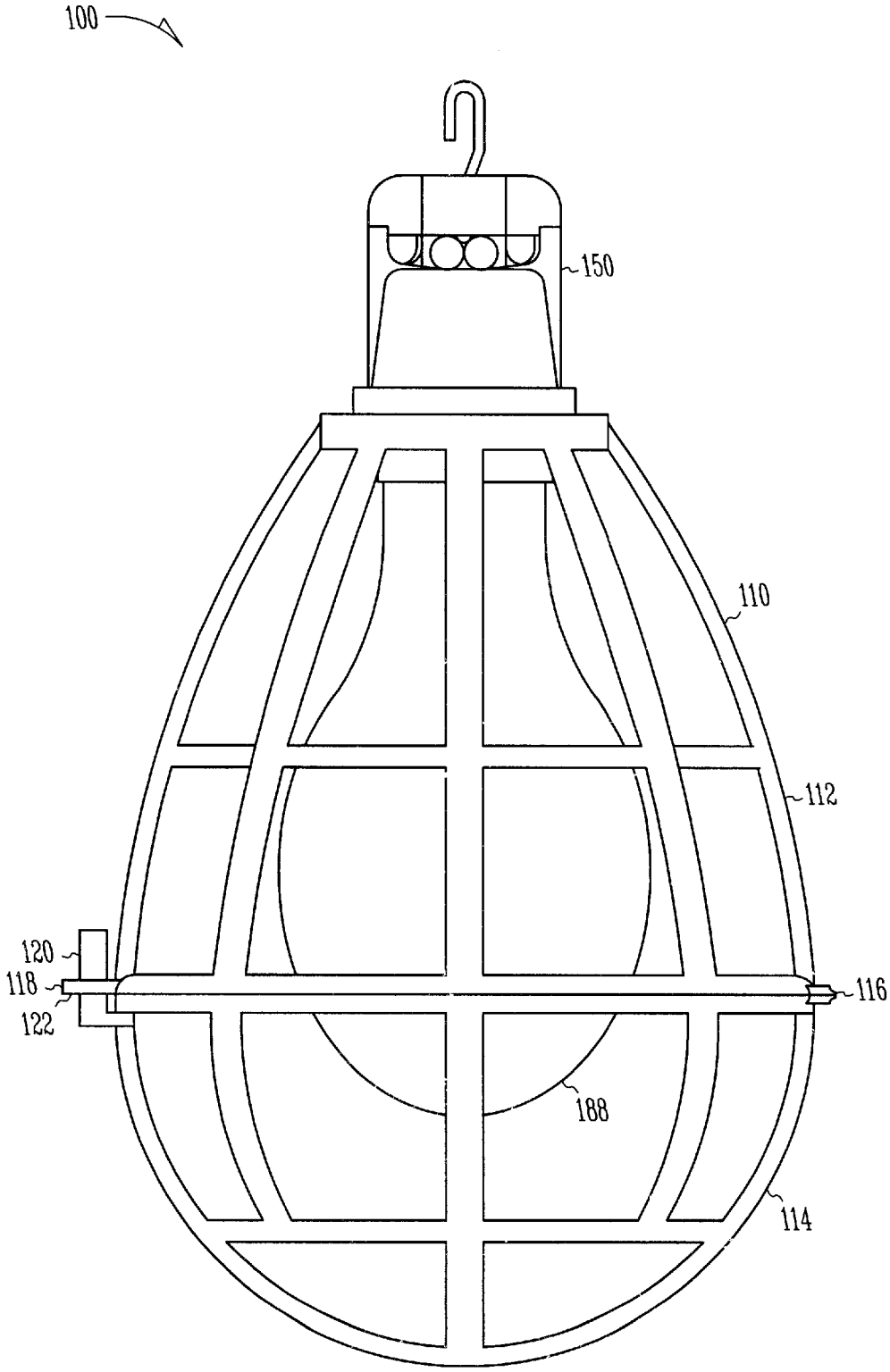
FIG. 8 is a front elevation of the temporary lighting apparatus constructed in accordance with one embodiment of the present invention.
Figure 9:
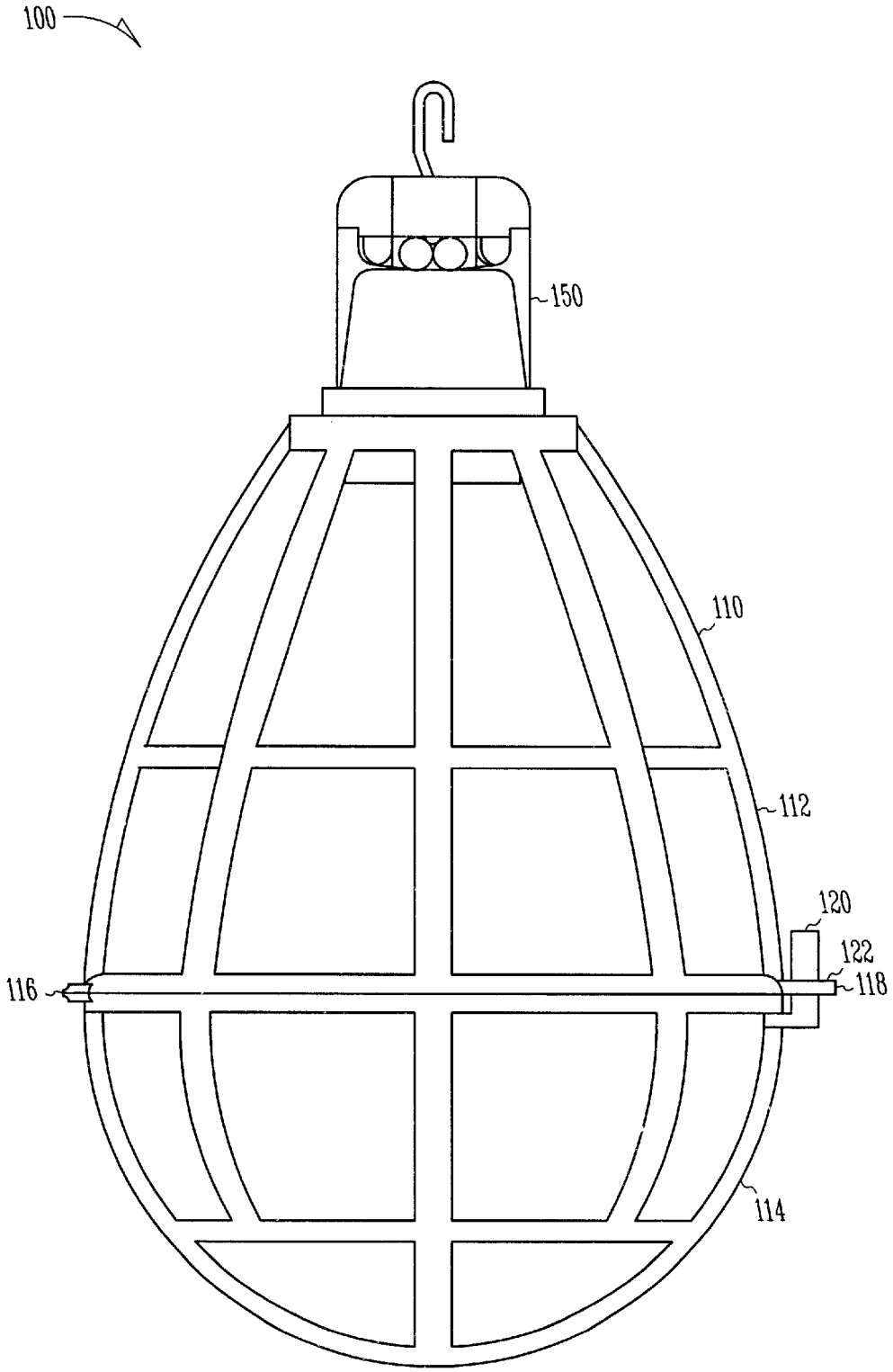
FIG. 9 is a rear elevation of the temporary lighting apparatus of FIG. 1.
Figure 10:
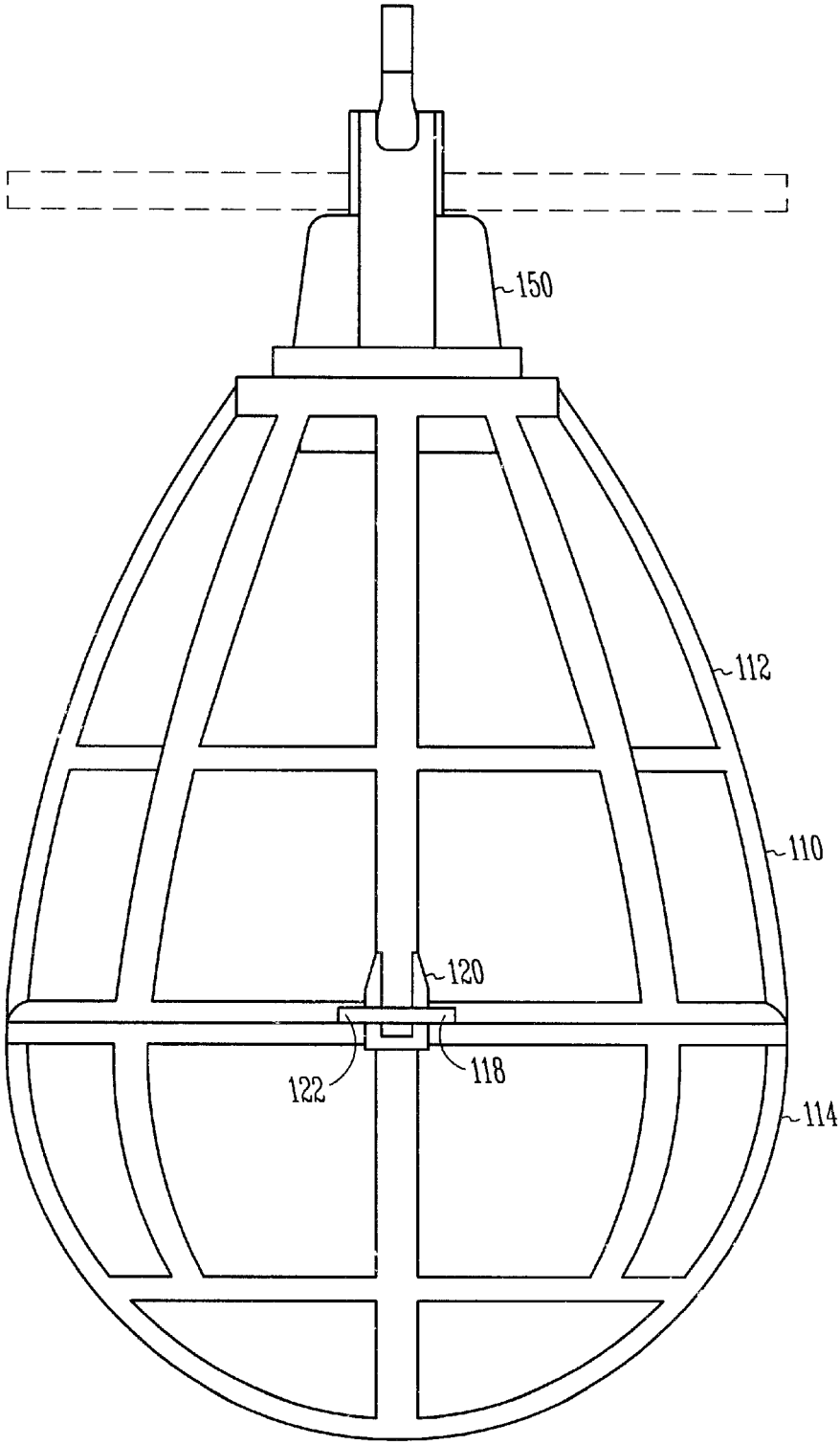
FIG. 10 is a right side elevation the temporary lighting apparatus of FIG. 1.
Figure 11:
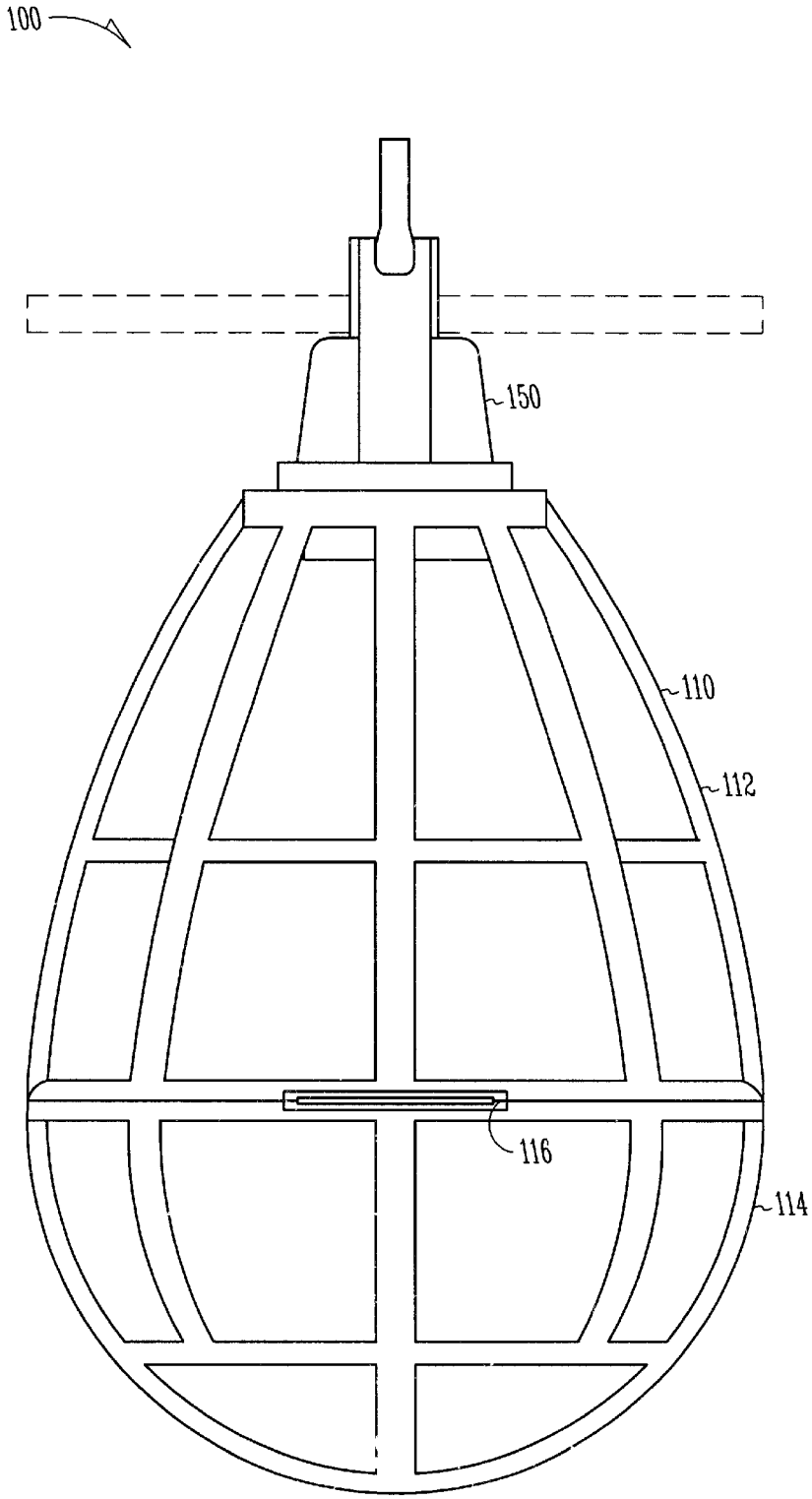
FIG. 11 is a left side elevation the temporary lighting apparatus of FIG. 1.
Figure 12:
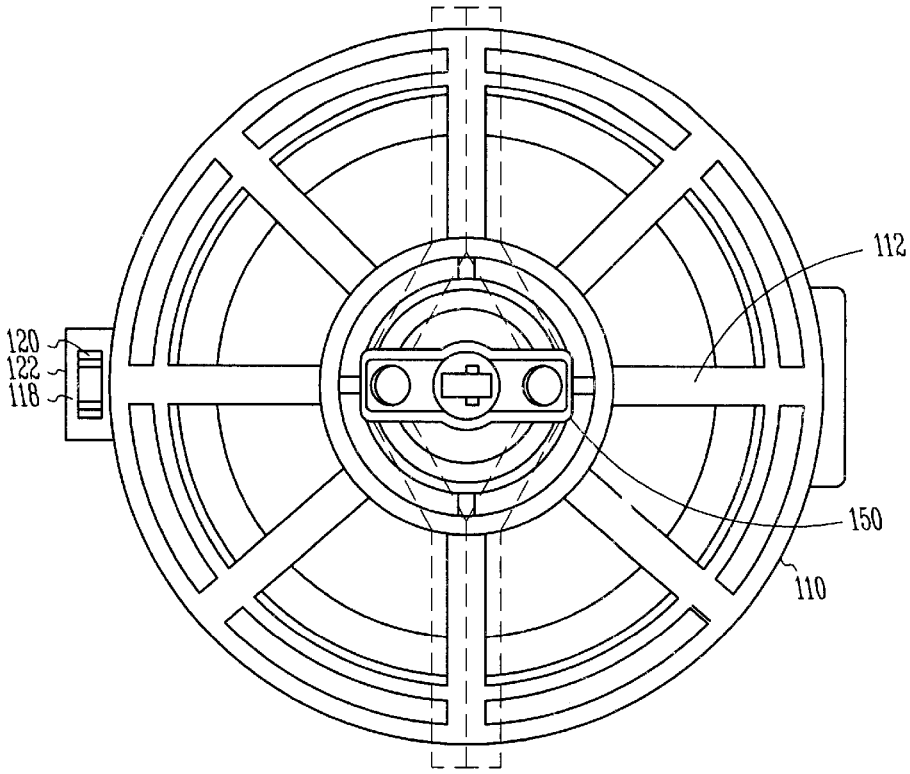
FIG. 12 is a top plan of the temporary lighting apparatus of FIG. 1.
Figure 13:
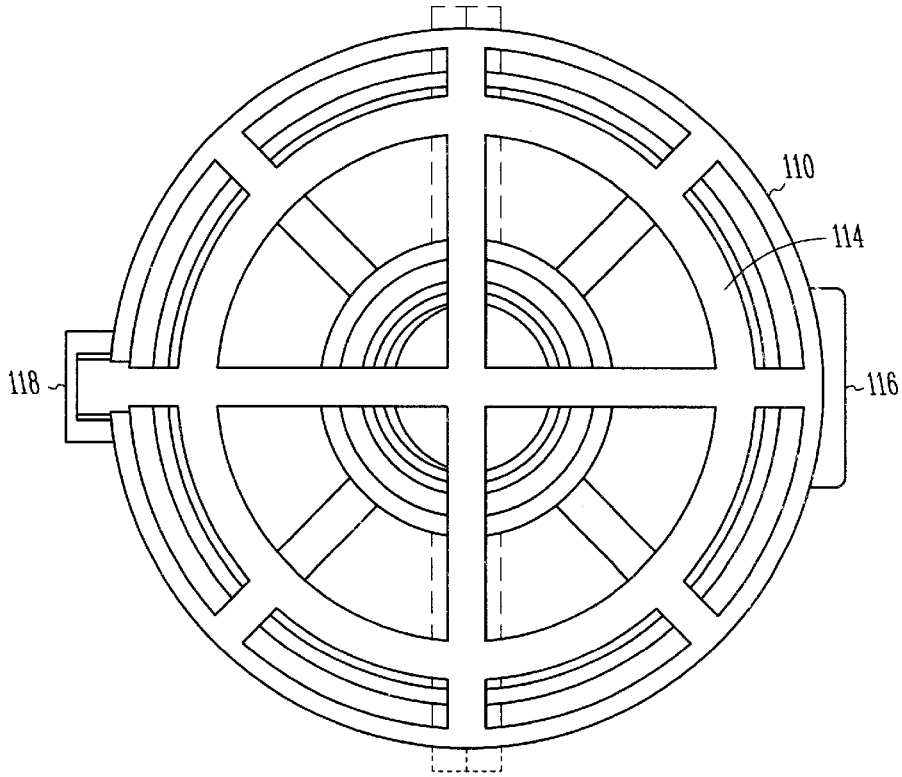
FIG. 13 is a bottom plan of the temporary lighting apparatus of FIG. 1.

As discussed above, the cage 110 is snap-fitted with the electrical socket 150, and the cage is shown in more detail in FIGS. 6–13. The cage 110 is formed of a plastic material and includes a first portion 112 and a second portion 114, which together generally form a spherical cage 110 which encompasses the light source 188 (FIG. 8). The second portion 114 and the first portion 112 are hingedly coupled together, for example, by a living hinge 116. The second portion 114, in one embodiment, is disposed at the bottom end of the cage 110 such that the second portion 114 hinges down away from the first portion 112 and the electrical socket 150. The first and second portions 112, 114 further include a latch mechanism 118 (FIG. 8) opposite the hinge 116. The latch mechanism 118 (FIG. 8) allows for second portion 114 to be partially disconnected from the first portion 112 such that the light source 188 (FIG. 8) can be changed. In one embodiment, the latch mechanism 118 comprises fingers 120 disposed on the second portion 114 which engage a suitably positioned catch 122, for instance, an aperture, on the first portion 112. The fingers 120 couple with the catch 122 in a snap-fit coupling.

The first portion 112 of the cage 110 extends from a top end 132 to a bottom end 134. At the top end 132 is a collar portion 136 which is adapted to couple with a socket 150 with a snap-fit connection. In one embodiment, the collar portion 136 includes a first collar 138 and a second collar 140. The first collar 138 and the second collar 140 are concentric rings where the first collar 138 is disposed within the second collar 140, and there is a gap 142 between the first collar 138 and the second collar 140. The gap 142 allows the first collar 138 to deflect toward the second collar 140 when the cage 110 is assembled to the electrical socket 150.

The first collar 138 is defined in part by an outer surface 144 which faces the second collar 140, and an inner surface 145 on the interior portion of the first collar 138. Disposed within the first collar 138 on the inner surface 145, in one embodiment, is at least one notch 146. The at least one notch 146 is sized to receive therein at least a portion of the projection 166 (FIGS. 3–5) of the electrical socket 150 as the cage 110 is being disposed over the electrical socket 150.

Figure 6A:
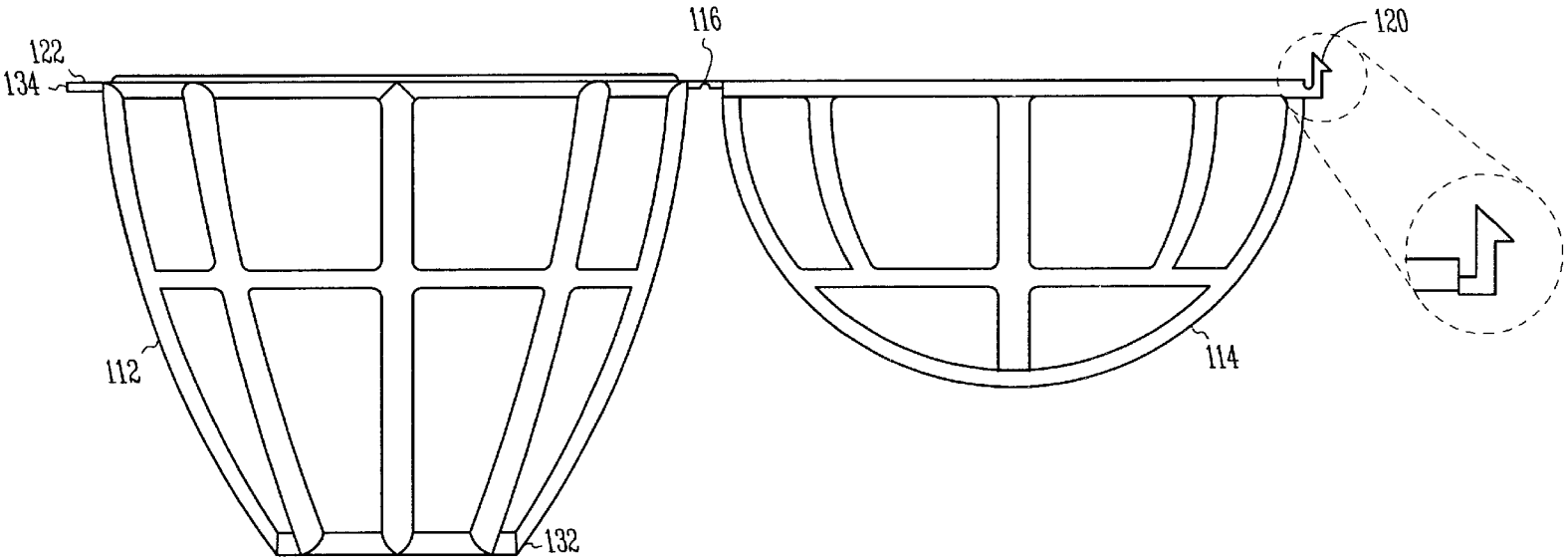
FIG. 6A is a side elevational view illustrating a cage of the temporary lighting apparatus.
Figure 6C:
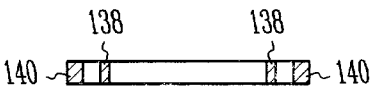
FIG. 6C is a cross-sectional view illustrating a view of FIG. 6B taken along 6C—6C.
Figure 6B:
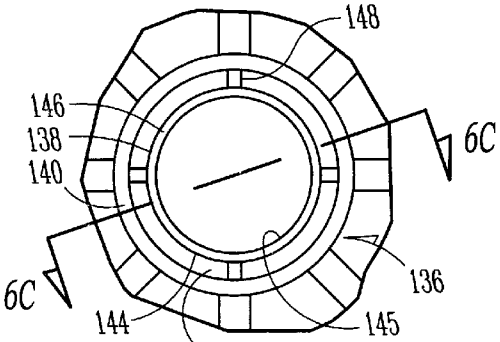
FIG. 6B is a bottom plan view of a portion of FIG. 6A.
Figure 7:
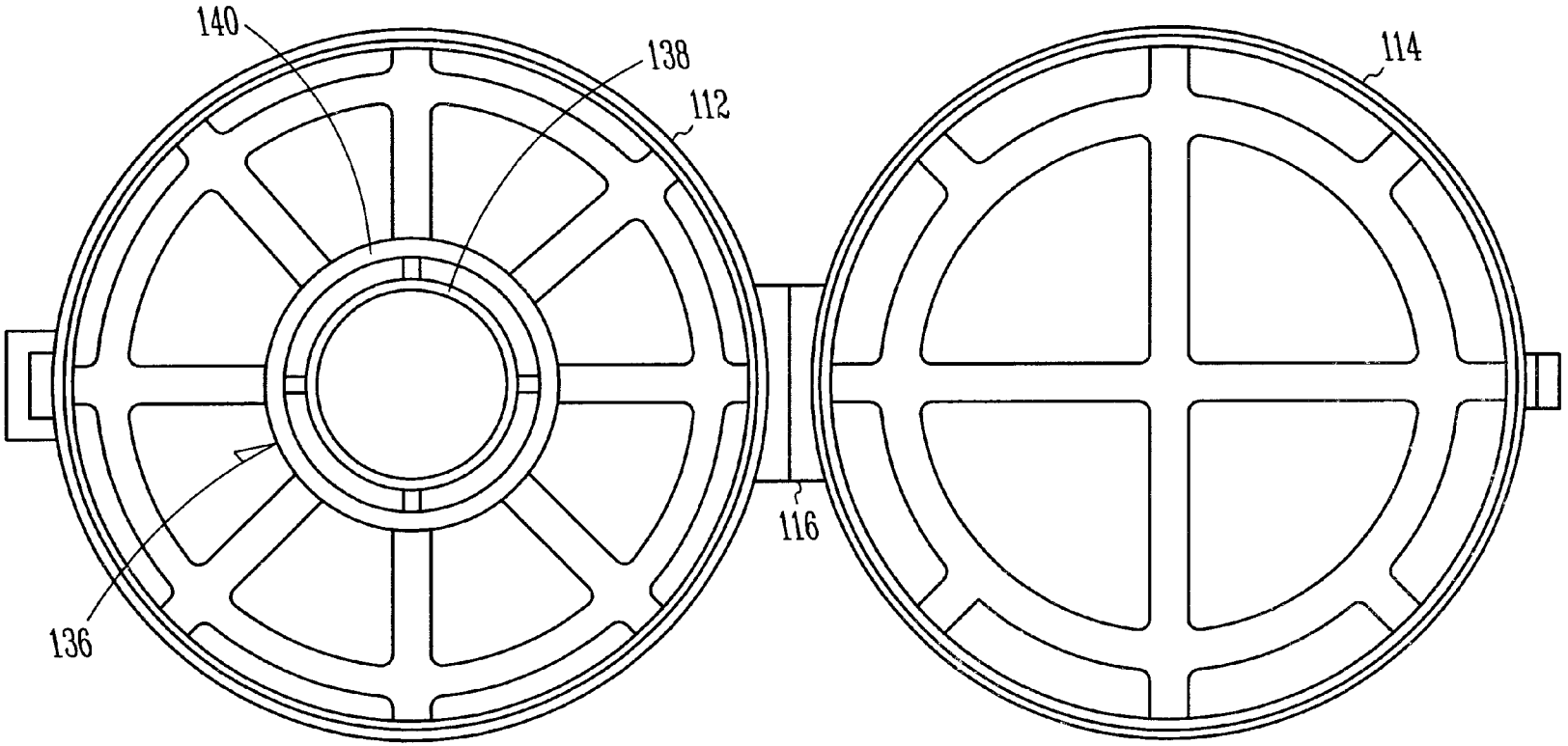
FIG. 7 is a bottom plan view illustrating a cage of the temporary lighting apparatus.

The second collar 140 is coupled with the first collar 138, by one or more radially extending members 148. In one embodiment, the members 148 include four members disposed at every quarter portion of the first and second collars 138, 140, as shown in FIG. 6. Alternatively, the second collar 140 can be coupled with the first collar 138 in other manners which allow the first collar 138 to deflect.

In another embodiment, as shown in FIG. 14, a cage 210 can be coupled with an electrical socket in other manners. In this embodiment, the cage 210 includes a plurality of deflective members 230 which couple with either recesses or mating projections of an electrical socket.

To assemble the temporary lighting apparatus 100, the first portion 112 of the cage 110 is snap-fitted with the electrical socket 150. In one embodiment, the collar portion 136 of the cage 110 is slipped over the bottom end 154 of the electrical socket 150 and pressed until the notches 146 pass over the projections 166. To replace the light source 188, the latch mechanism 118 is released and the second portion 114 is hinged away from the first portion 112 of the cage 110, thereby allowing access to the light source 188 within the cage 110 without having to remove the cage 110 from the electrical socket 150.

Advantageously, the temporary lighting apparatus allows for the units to be quickly installed and uninstalled with the snap-fit coupling, also saving in labor costs. The lighting apparatus beneficially can be installed without the use of tools or hardware. In addition, the temporary lighting apparatus provides an inexpensive approach to installing and manufacturing the product. Furthermore, the lighting apparatus is easy to use and does not get too warm to handle from the heat of the light source.

It is to be understood that the above description is intended to be illustrative, and not restrictive. Many other embodiments will be apparent to those of skill in the art upon reading and understanding the above description. For instance, other types of snap-fit connections can be incorporated with the lighting apparatus. The scope of the invention should, therefore, be determined with reference to the appended claims, along with the full scope of equivalents to which such claims are entitled.

What is claimed is:

1. A cage for a lighting apparatus comprising:

a first portion and a second portion forming an enclosure for a light source, the first portion extending from a first end to a second end;

the first end including a collar portion adapted to couple with an electrical socket with a snap fit connection;

the second end of the first portion hingedly coupled with the second portion; and wherein the electrical socket extends from a top end to a bottom end with an intermediate portion therebetween, the electrical socket comprising a first outer ring and a second outer ring, the first outer ring disposed at the bottom end of the electrical socket and the second outer ring disposed at the intermediate portion.

2. The cage of claim 1 wherein the collar portion comprises a first collar and a second collar.

3. The cage of claim 2 wherein the first collar and the second collar are concentric rings and the first collar is disposed within the second collar.

4. The cage of claim 2 wherein the collar portion further comprises a gap between the first collar and the second collar, and the gap allows the first collar to deflect toward the second collar.

5. The cage of claim 2 wherein the collar portion has at least one notch.

6. The cage of claim 5 wherein the at least one notch is sized to receive at least a portion of a projection of the electrical socket.

7. The cage of claim 2 wherein the second collar is coupled with the first collar by at least one radially extending member.

8. A temporary lighting apparatus comprising:

a cage having a first portion and a second portion, the cage forming an enclosure for a light source;

the first portion of the cage extending from a first end to a second end;

the second end of the first portion hingedly coupled with the second portion;

an electrical socket couplable with the light source;

wherein the cage is coupled to the electrical socket with a snap fit connection;

the first end including a first collar and a second collar, where the first collar and the second collar are concentric rings and the first collar is disposed within the second collar, and a gap is formed between the first collar and the second collar, and the gap allows the first collar to deflect toward the second collar; and wherein the electrical socket extends from a top end to a bottom end with an intermediate portion therebetween, the electrical socket comprising a first outer ring and a second outer ring, the first outer ring disposed at the bottom end of the electrical socket and the second outer ring disposed at the intermediate portion.

9. A temporary lighting apparatus comprising:

a cage having a first portion and a second portion, the cage forming an enclosure for a light source;

the first portion of the cage extending from a first end to a second end;

the second end of the first portion hingedly coupled with the second portion;

an electrical socket couplable with the light source;

wherein the cage is coupled to the electrical socket with a snap fit connection; and wherein the electrical socket extends from a top end to a bottom end with an intermediate portion therebetween, the electrical socket comprising a first outer ring and a second outer ring, the first outer ring disposed at the bottom end of the electrical socket and the second outer ring disposed at the intermediate portion.

10. The lighting apparatus of claim 9 wherein the second outer ring comprises a stop for the cage.

11. The lighting apparatus of claim 10 further comprising at least one snap-fit coupling feature disposed on the first outer ring.

12. The lighting apparatus of claim 11 wherein the snap-fit coupling feature comprises a projection extending from the first outer ring.

13. The lighting apparatus of claim 12 wherein the projection is angled from a top surface to a bottom surface forming an angled portion therebetween.

14. The lighting apparatus of claim 13 wherein the angled portion facilitates disposing the cage over the projection until the cage is positioned on the electrical socket.

15. The lighting apparatus of claim 11 wherein the at least one snap-fit coupling feature comprises a plurality of projections disposed about the circumference of the first outer ring.

16. The lighting apparatus of claim 9 wherein the cage includes a plurality of deflective members and the socket includes recesses, and the deflective members couple with recesses.

17. The lighting apparatus of claim 9 wherein the cage comprises a plurality of projections, wherein the projections couple with the electrical socket.

18. The lighting apparatus of claim 9 wherein the cage comprises a plurality of deflective members and the electrical socket comprises recesses, wherein the deflective members couple with the recesses.

19. A method of assembling a lighting apparatus comprising:

providing an electrical socket and a cage, the cage having a first portion and a second portion, the first portion hinged to the second portion and the first portion releaseably latched to the second portion, thereby allowing access to a light source within the cage without removing the-cage from the electrical socket, wherein the electrical socket extends from a top end to a bottom end with an intermediate portion therebetween, the electrical socket comprising a first outer ring and a second outer ring, the first outer ring disposed at the bottom end of the electrical socket and the second outer ring disposed at the intermediate portion; and snap fitting the cage to the electrical socket.

20. The method of claim 19 further comprising positioning a collar portion of the cage over a bottom end of the electrical socket and pressing the cage towards the electrical socket until the cage is secured to the electrical socket.

* * * * *